US007128353B2

(12) United States Patent
Jussila et al.

(10) Patent No.: US 7,128,353 B2
(45) Date of Patent: Oct. 31, 2006

(54) APPARATUS FOR A LOCKING UNIT OF A CONTAINER SPREADER

(75) Inventors: Olavi Jussila, Hyvinkää (FI); Jari Kaiturinmäki, Helsinki (FI)

(73) Assignee: KCI Konecranes PLC., Hyvinkää (FI)

( * ) Notice: Subject to any disclaimer, the term of this patent is extended or adjusted under 35 U.S.C. 154(b) by 197 days.

(21) Appl. No.: 10/493,840

(22) PCT Filed: Oct. 29, 2001

(86) PCT No.: PCT/FI01/00940

§ 371 (c)(1),
(2), (4) Date: Jul. 26, 2004

(87) PCT Pub. No.: WO03/037775

PCT Pub. Date: May 8, 2003

(65) Prior Publication Data

US 2004/0256266 A1 Dec. 23, 2004

(51) Int. Cl.
*B66C 1/66* (2006.01)

(52) U.S. Cl. ..... 294/81.53; 294/81.21

(58) Field of Classification Search ..... 294/81.21, 294/81.53, 67.32

See application file for complete search history.

(56) References Cited

U.S. PATENT DOCUMENTS 3,551,964 A * 1/1971 Shaw ..... 294/81.53
3,734,442 A 5/1973 Lunde
3,751,096 A * 8/1973 Wyon ..... 294/81.53
3,980,185 A 9/1976 Cain
4,630,856 A * 12/1986 Peeters Weem et al. . 294/81.53

FOREIGN PATENT DOCUMENTS

| | | |
|---|---|---|
| DE | 2227823 A | 12/1973 |
| EP | 0442154 A1 | 8/1991 |
| GB | 2294027 A | 4/1996 |
| JP | 8026654 | 1/1996 |
| SE | 339740 B | 10/1971 |

* cited by examiner

*Primary Examiner*—Dean J. Kramer
(74) *Attorney, Agent, or Firm*—Birch, Stewart, Kolasch & Birch, LLP

(57) ABSTRACT

An apparatus for a locking unit of a container spreader having at least a pair of telescopic beams comprising a housing, a twistlock head partially inside the housing and partially protruding out from the housing, an elastic impact absorption element and a toothed coupling to transmit the necessary engagement torque to the twistlock head. The locking unit is equipped with a coupling that has been arranged to allow the movement of the twistlock head in all directions on a plane perpendicular to the rotation axis of the twistlock head.

7 Claims, 4 Drawing Sheets

APPARATUS FOR A LOCKING UNIT OF A CONTAINER SPREADER

FIELD OF INVENTION

The present invention relates to an apparatus for a locking unit of a container spreader.

DESCRIPTION OF THE BACKGROUND ART

Traditionally, for the lifting of containers an especially just for that purpose designed loading means called spreader is used. The spreader engages with the lifting holes situated on the corners of the container with its locking units called twistlocks. The apparatus is used in connection with different forklift trucks and reach trucks moving on wheels, and cable cranes.

During the operation fairly hard impact stresses are directed towards the spreader and therefore the whole operation has to be stopped very often for repairing or changing of the whole apparatus.

Another problem is to be able to aim the twistlocks at the lifting holes on the corners of the container due to the manufacturing tolerances of containers and damages during a transport.

In order to be able to engage the twistlocks reliably it is essential to recognize the distance of the container from the twistlock so that all the twistlocks are simultaneously in the correct place. Recognizing limit switches are damaged fairly easily because accelerations are extremely high.

Also distortions of moving rods or levers can easily cause malfunctions. In those cases also counter surfaces on the supporting structure can be damaged and the whole structure has to be repaired or changed.

Prior-art technology in the field of the invention is represented for example by the patents GB2294027 and EP0442154. In these publications different types of absorption solutions and levers for recognizing the corners of the container are presented. In both cases the concentration is directed mainly at the absorption of the axial force, and as to the guidance of the twistlock, at the swing in relation to the self-aligning bearing.

Swedish patent publication SE 339740 shows a twistlock arrangement where moving parts are situated inside a closed space, and where the coupling for transmitting the torque does not move in the vertical direction. A disadvantage of the solution presented by the Swedish patent publication is the fact that it is complicated of its structure and that receiving of the horizontal forces is fairly poor.

BRIEF SUMMARY OF THE INVENTION

The purpose of the present invention is to remove defects, complex structures, weight, additional maintenance and expensive repairing work of the prior art technology.

The object of the present invention is to develop the structure of the locking unit so that impact stresses in all directions can be absorbed with sufficient elasticities without exceeding at any point the yield limit or fatigue strength of the material.

The solution according to the invention has many advantages compared to the previously known solutions. In the following some of the main advantages are shortly described.

The invention provides a structure where the twistlock head has been manufactured from only one piece of material. The material can be for example forged or hammered steel or the like. The advantage of the structure is that the twistlock head is very durable that makes the structure reliable and safe. No threads or corresponding fastening elements on the shaft of the twistlock head are needed. The threads can weaken the shaft of the twistlock head so that the shaft can be broken under a heavy strain much more easily than the shaft without the threads or the like. It is also possible that a joint with the threads or the like opens accidentally causing a dangerous situation. Another advantage is that all moving components have been packed in a sealed, tubular space that is fixed between two support surfaces. Firstly this kind of structure slows down the effect of corrosion and by that way increases reliability. Secondly guide means on the support surfaces locate the twistlock head precisely to the correct position. Also the elastic elements of the locking unit have been protected well against climatic influences and they are able to receive impacts from all directions. The locking unit is very lightweight and the twistlock head moves easily in the radial direction when the twistlock head seeks its way to the hole on the corner of the container. The radial movement of the twistlock head in all directions is possible because the torque needed for the function of the twistlock head is transmitted with a coupling that has two wedge grooves in 90.degree. angle with each other. The control of the engagement angle and the force needed for the engagement is precise because thanks to the structure the position of the lever arm transmitting the needed torque for the engagement is always the same regardless of the deviation of the twistlock head. Further resulting from the previous fact the engagement and disengagement of two twistlock heads can be carried out by only one actuator whereas in the prior art solutions a separate hydraulic cylinder is needed for each four twistlock heads.

Further scope of the applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

In the following, the invention will be described in detail by the aid of one of its embodiments with reference to the drawings which are given by way of illustration only, and thus are not limitative of the present invention, and, wherein.

DETAILED DESCRIPTION OF THE INVENTION

Figure 1:
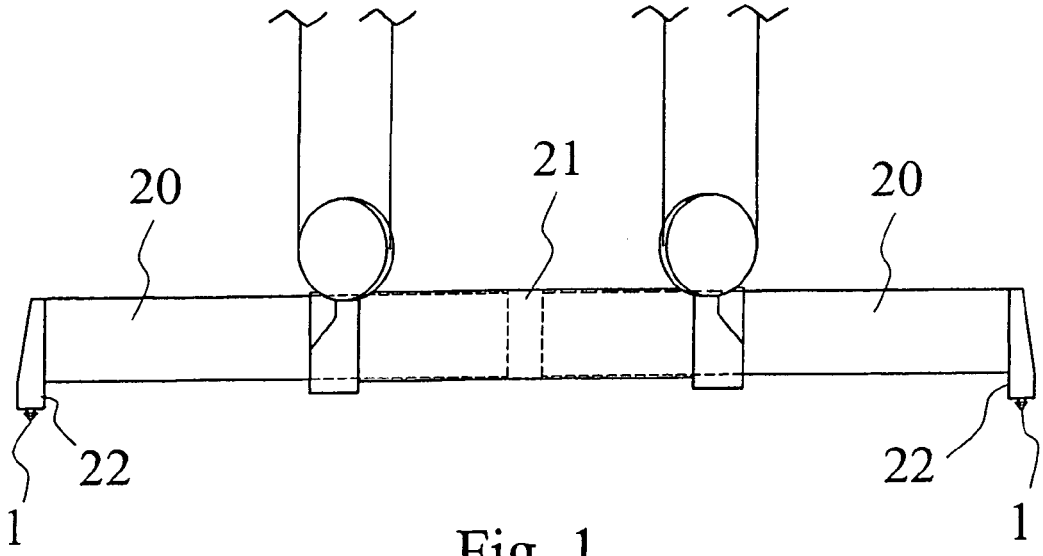
FIG. 1 presents a spreader in a side view.
Figure 2:
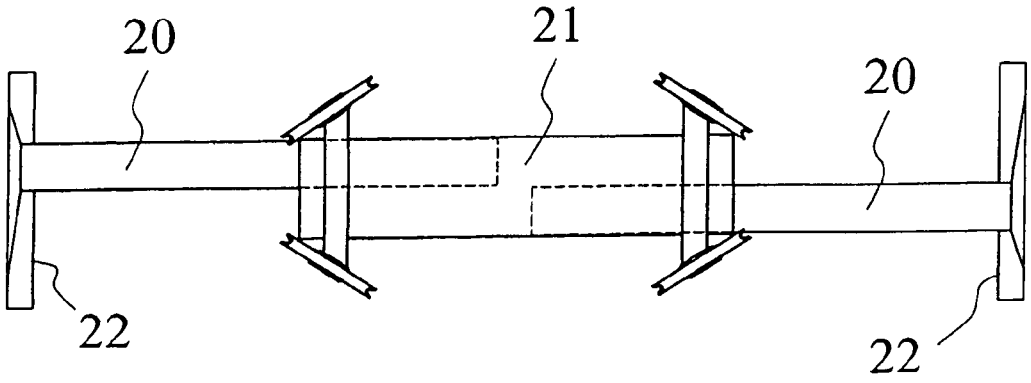
FIG. 2 presents the same spreader seen from above.

FIGS. 1 and 2 illustrate a spreader that is suspended by hoisting ropes. The spreader consists of a structural frame 21 that supports two telescopic beams 20 so that the beams can be moved partially inside to the structural frame. In this way the length of the spreader can be adjusted according to the length of the container to be lifted. An end beam 22 is situated perpendicular to the telescopic beam 20 at the outer end of each telescopic beam. The locking units comprising twistlock heads that are engaged with the container to be lifted are situated correspondingly at each corner of the end beams 22. Altogether the number of the locking units is four.

Figure 3:
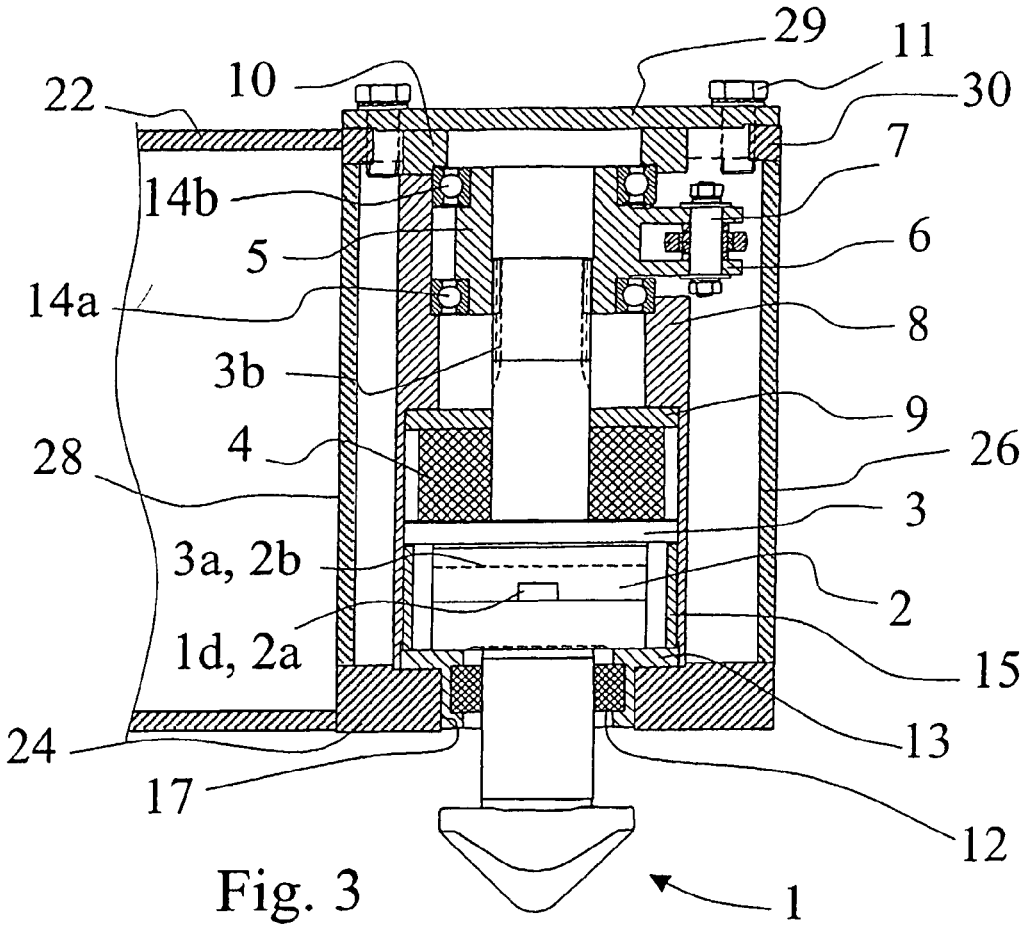
FIG. 3 presents the more detailed structure of the locking unit in a cross-sectional view according to the line III—III in FIG. 4.
Figure 4:
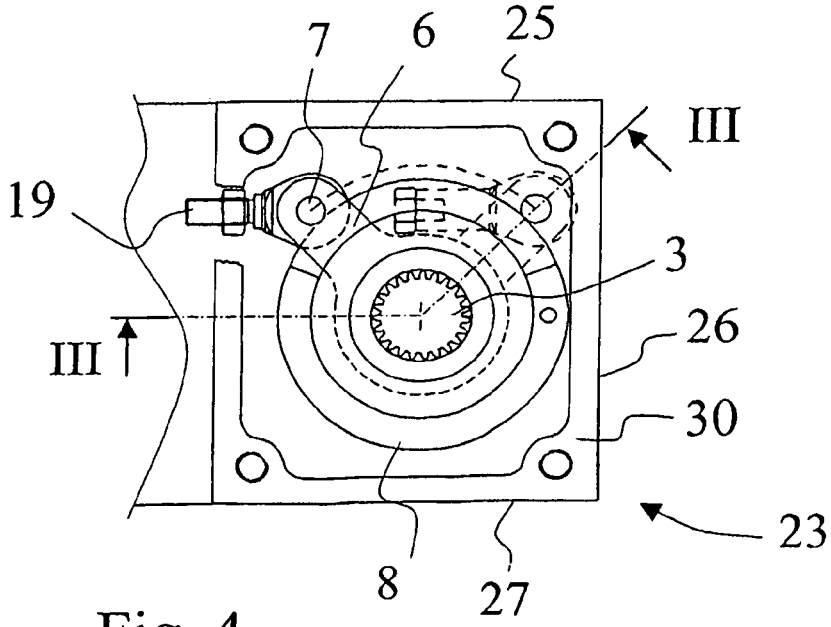
FIG. 4 presents the more detailed structure of the locking unit seen from above.
Figure 5:
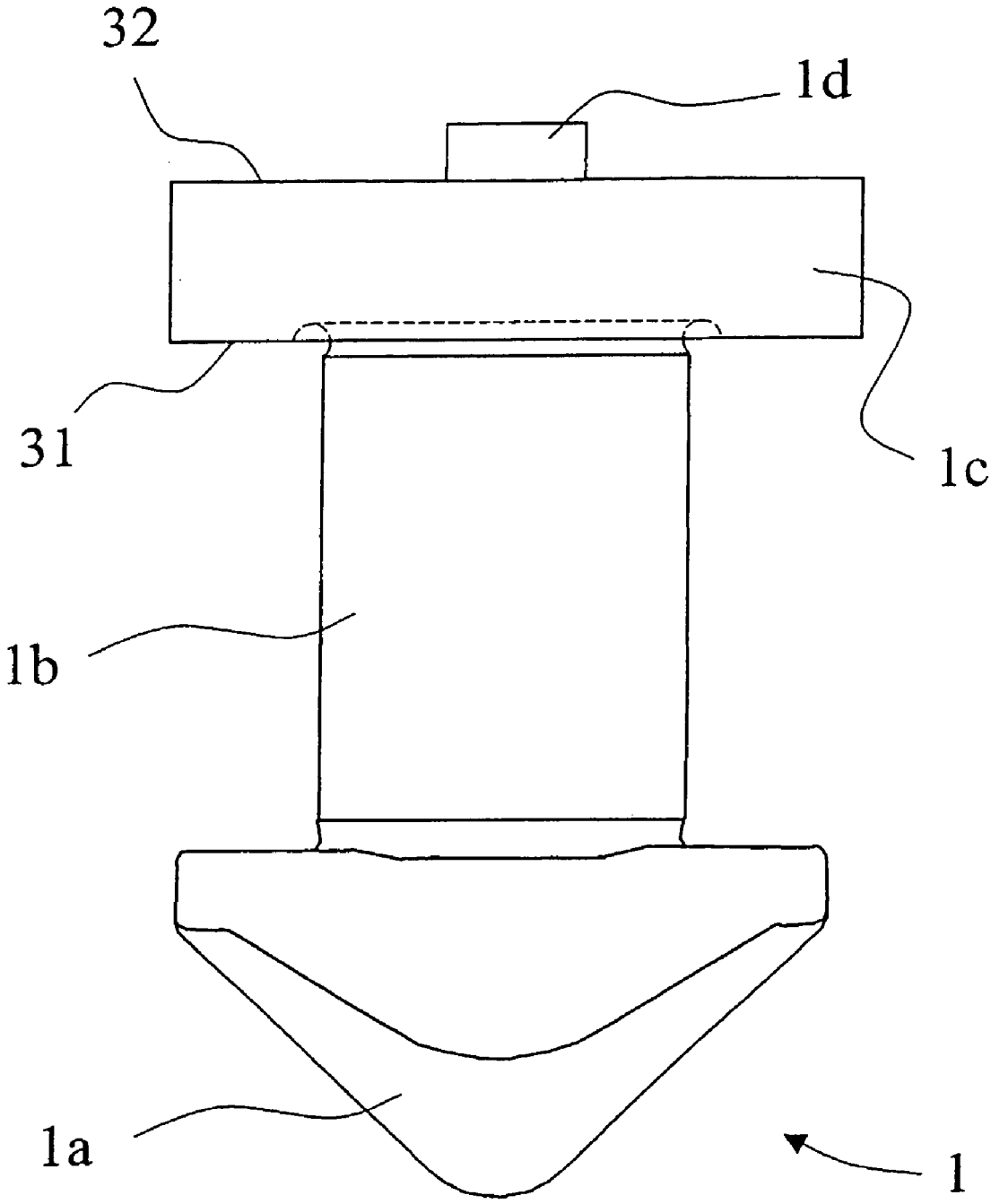
FIG. 5 presents the twistlock head according to the present invention in a side view.

FIGS. 3, 4 and 5 present a detailed structure of the corner of the spreader and the twistlock head 1. All the four corners with the locking units are essentially identical.

The cross-sectional view in FIG. 3 illustrates the location of the locking unit at the end of the end beam 22. In the situation seen in the FIG. 3 the twistlock head 1 has been rotated 90° to the position where the twistlock head has been engaged with the container to be lifted. The twistlock assembly is positioned essentially inside a rectangular box acting as a housing 23 for the twistlock assembly. The housing 23 is secured into the corner of the end beam 22 by welding or the like. The housing 23 consists of sidewalls 25–28, a reinforced base plate 24 and a reinforced top plate 30. The housing is closed as a sealed unit by a reinforced cover plate 29 that is secured to the top plate 30 of the housing by screws 11. The base plate 24 has a circular hole 17 for the twistlock head 1 to go through.

The twistlock assembly consists of four main elements and other elements supporting and guiding the main elements. One of the main elements is the twistlock head 1 that consists of an engaging part 1*a*, a vertical shaft 1*b* and a flange 1*c* with a wedge 1*d* forming a coupling part. The lower surface 31 of the coupling part extends perpendicularly outwards from shaft 1*b* and is essentially flat and straight and supports the twistlock head 1 in its position. The lower surface 31 of the coupling part rests on a two-piece sleeve 13 that is fitted into the hole 17. When a container is lifted the force is transmitted from the twistlock head 1 directly to the two-piece sleeve 13 and further from the sleeve to the end beam 22 and further to the telescopic beam 20. The sleeve 13 has an internal circular groove for the circular elastic ring 12 that has been adjusted to surround the shaft 1*b* of the twistlock head 1. The elastic ring has been stretched on the shaft over the engaging part 1*a* of the twistlock head. The biggest overall dimension of the engaging part of the twistlock head 1 is smaller than the diameter of the hole 17 in order to make the assembly of the twistlock possible.

Another main component is a coupling 2 that acts as a cross-coupler and rests on the flange 1*c* of the twistlock head 1. The coupling has two rectangular wedge grooves 2*a* and 2*b* which are perpendicular to each other. The wedge groove 2*a* is located on the lower surface of the coupling and the wedge groove 2*b* is located on the upper surface of the coupling.

A further main component is a piston 3 that rests on an intermediate sleeve 15 that rests correspondingly on the two-piece sleeve 13. The height of the intermediate sleeve 15 is so adjusted that a small gap exists between the upper surface of the coupling 2 and the lower surface of the piston 3. A rectangular wedge 3*a* protrudes in the middle of the lower surface of the piston 3. The protrusion of the wedge 3*a* has been so dimensioned that a small gap exists between the lower surface of the wedge and the bottom of the groove 2*b*. Because in normal situation there is the small gap between the piston 3 and the coupling 2 it makes it possible for the twistlock head to move easily in the radial direction guided by the wedge surfaces. The upper part of the piston shaft has been equipped with spur teeth 3*b* to mesh with an internally toothed coupling 5 that is the fourth main component of the twistlock assembly. The toothed coupling 5 is located partially above the piston 3 50 that the piston can move inside the coupling in an axial direction. A lever arm 6 extents radially from the perifery of the toothed coupling 5. In order to transmit the necessary engagement and disengagement torque to the twistlock head 1 the lever arm 6 has been connected to a transmission rod 18, 19 with a joint 7.

The upper part of the twistlock head 1, coupling 2, intermediate sleeve 15, piston 3 and toothed coupling 5 are situated inside a tubular guiding sleeve 8. The guiding sleeve 8 is positioned in its place by the two-piece sleeve 13. The toothed coupling 5 rests on a bearing 14*a* that is supported by the internal shoulder of the guiding sleeve 8. Another bearing 14*b* guides the toothed coupling 5 at its upper end, and the tubular system is closed with an intermediate ring 10 situated between the sleeve 8 and the cover plate 29.

A counter plate 9 is situated around the shaft of the piston 3 inside the guiding sleeve 8. The guiding sleeve 8 receives forces from the piston 3 through an elastic absorption element 4 that is located vertically between the upper surface of the flange of the piston 3 and the lower counter surface of the counter plate 9. The forces received by the counter plate 9 are directed to the reinforced cover plate 29 through the guiding sleeve 8 and the intermediate ring 10.

In FIG. 4 that is a top view of the housing 23, the cover plate 29 and the intermediate ring 10 have been removed for clarification. Also both the extreme positions of the lever arm 6 are seen in the figure.

In FIG. 5 the twistlock head 1 is presented in more detail. It is essential that the twistlock head 1 has been manufactured only from one piece. Thus the twistlock head 1 is an integral unit consisting of the engagement part 1*a*, the shaft 1*b* and the flange 1*c*. The vertical shaft 1*b* connects the engaging part 1*a* and the flange 1*c* together. A rectangular wedge 1*d* protrudes in the middle of the upper surface 32 of the flange 1*c*. The longitudinal direction of the wedge 1*d* is perpendicular to the direction of the biggest overall dimension of the engaging part of the twistlock head 1.

Figure 6:
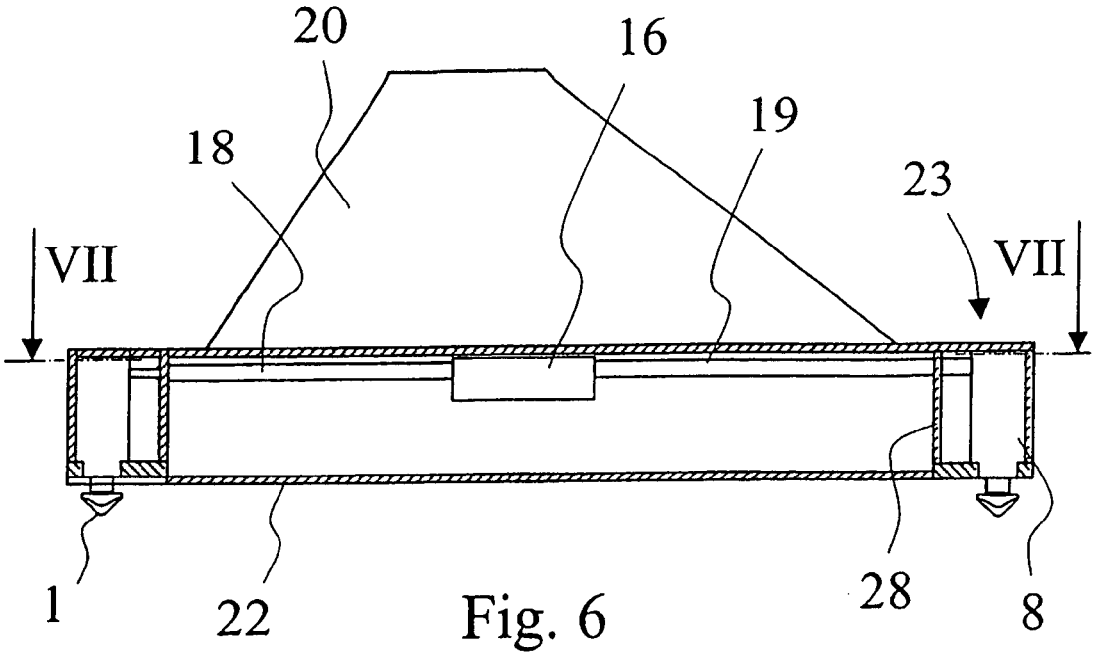
FIG. 6 presents the actuator arrangement according to the present invention in a cross sectional side view and in a simplified mode.
Figure 7:
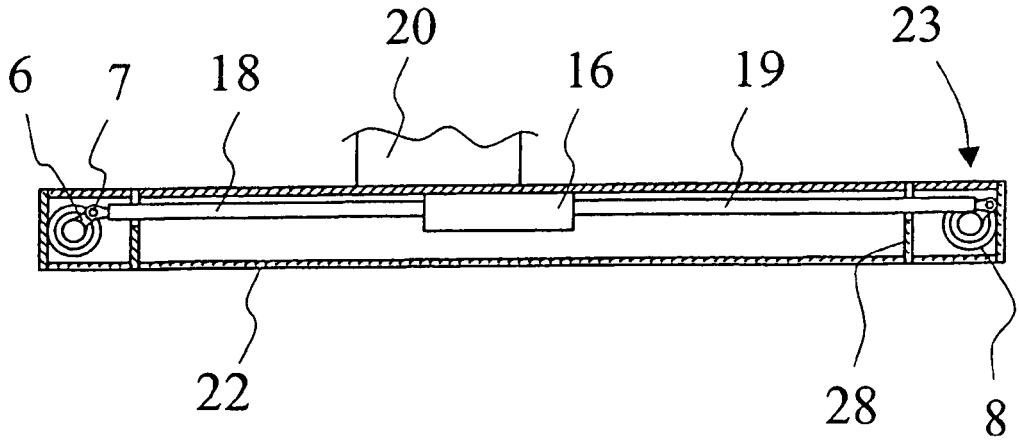
FIG. 7 presents the actuator arrangement according to the present invention in a cross sectional view according to the line VII—VII in FIG. 6, and in a simplified mode.

FIGS. 6 and 7 illustrate the operation of the twistlocks in principle. An actuator 16 situated in the center part of the end beam 22 has been connected with the transmission rods 18, 19. When the actuator is activated it turns the lever arms 6 through the transmission rods and the joints 7. As is seen in FIG. 6 the transmission rod 18 has pulled the left-hand lever arm 6 to the right and correspondingly the transmission rod 19 has pushed the right-hand lever arm 6 to the same direction. By this way the twistlock heads are rotated 90° both clockwise and anti-clockwise. The actuator 16 can be a hydraulic cylinder, screw machinery, rope machinery or other generally known mechanism for a linear motion.

The function of the apparatus according to the invention is as follows:

An object of the invention has been an apparatus arrangement where the function of the twistlocks can be made as safe as possible. The configuration should be durable and it should receive impacts by absorbing them. Also the fast and easy interchangeability of the locking unit when necessary has been observed.

If the twistlock head 1 hits the edge of the lifting hole on the corner of the container when lowering the spreader, the elastic ring 12 that acts as a sealing and a positioner element yields about 10 mm. Because the coupling 2 has wedge grooves 2*a* and 2*b* that are perpendicular to each other, the twistlock head 1 is allowed to move freely on a horizontal plane to all directions. That makes it possible to equip the locking unit with the toothed coupling 5 so that the radial movement of the twistlock head (1) has been separated from the toothed coupling (5). Therefore the toothed coupling is independent from the movements of the twistlock head 1 and can be installed fixedly at its location. The only movement the toothed coupling (5) has been arranged to do is a rotational movement.

Correspondingly if the twistlock head 1 hits the container in a vertical direction with a full speed the piston 3 tends to rise up towards the elastic absorption element 4 that transmits the force through the counter plate 9, guiding sleeve 8 and intermediate ring 10 to the cover plate 29. For the necessary expansion a space has been reserved outside the periphery of the elastic absorption element 4.

An impact on the horizontal plane is received first with the elastic ring 12. If the impact exceeds the elasticity of the elastic ring 12 the twistlock head 1 leans on the two-piece sleeve 13 and when the tilting of the twistlock head 1 continues around the lower edge of two-piece sleeve 13 the edge of the flange 1*c* and the coupling 2 rise upwards causing the piston 3 to rise and further to press the elastic absorption element 4. This is the way how the elastic absorption element 4 absorbs also forces caused by the tilting of the twistlock head 1.

When the twistlock head 1 is engaged the torque is brought by the help of the lever arm 6 to the toothed coupling 5. From the toothed coupling the torque is further transmitted to the piston 3, and further through the coupling 2 to the twistlock head 1. After the load has been removed the elastic ring 12 returns the twistlock head 1 always to the central position.

When engaging with the container the lifting holes of the one end of the container corners can be easily situated out off the presumed correct position. The dislocation can be at maximum 10 mm to any direction. According to the invention the position of the toothed coupling 5 is fast and independent from the position of the twistlock head 1. That is why both the twistlock heads at the same end beam 22 can be operated by only one actuator 16 that rotates both twistlock heads 1 by the same angle with the help of the transmission rods 18 and 19. Equally the other two twistlock heads 1 at the other end beam 22 can be operated simultaneously and rotated by the same angle. Usually the angle is constant having the value of 90°.

It is obvious to the person skilled in the art that the invention is not restricted to the examples described above but that it may be varied within the scope of the claims presented below.

The invention claimed is:

1. An apparatus for a locking unit of a container spreader having at least a pair of telescopic beams comprising a housing, a twistlock head partially inside the housing and partially protruding out from the housing, an elastic impact absorption element and a toothed coupling to transmit the necessary engagement torque to the twistlock head, the twistlock head is an integral unit having at least an engagement part, a shaft and a flange, the flange has an essentially flat shape with a rectangular wedge on an upper surface that is parallel with a lower surface of the flange, the locking unit is equipped with a coupling that has been arranged to be in touch with the upper surface of the flange to allow movement of the twistlock head in all directions on a plane perpendicular to a rotation axis of the twistlock head, and to separate the radial movement of the twistlock head from the toothed coupling.

2. The apparatus according to claim 1, wherein the flange situated on the upper end of the twistlock head has an essentially flat lower surface extending perpendicularly outwards from the shaft.

3. The apparatus according to claim 1, wherein the locking unit further comprises a piston arranged to mesh with the toothed coupling at its upper end and adjusted to match with the coupling at its lower end to transmit the torque from the toothed coupling to the twistlock head.

4. An The apparatus according to claim 3, wherein the toothing between the toothed coupling and the piston is arranged to allow the axial movement of the piston with respect to the toothed coupling.

5. An The apparatus according to claim 4, wherein the elastic impact absorption element is arranged to absorb in the axial direction of the piston effecting forces caused by the axial movement or tilting of the twistlock head.

6. The apparatus according to claim 4, wherein for the rotation of the twistlock head the apparatus comprises an actuator that is arranged to provide the necessary engagement torque to two of the locking units at the same end of the telescopic beam of the spreader, and that the rotation angle of the twistlock head is the same for the locking units.

7. The apparatus according to claim 1, wherein the locking unit further comprises an elastic ring that is arranged to surround the shaft of the twistlock head and to yield in a horizontal direction when necessary.

* * * * *